US012808375B2

(12) United States Patent
Suzuki

(10) Patent No.: US 12,808,375 B2
(45) Date of Patent: Nov. 24, 2026

(54) SCROLL-TYPE FLUID MACHINE

(71) Applicant: Hitachi Industrial Equipment Systems Co., Ltd., Tokyo (JP)

(72) Inventor: Ryoya Suzuki, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 19/104,732

(22) PCT Filed: Mar. 24, 2023

(86) PCT No.: PCT/JP2023/011992
§ 371 (c)(1),
(2) Date: Feb. 19, 2025

(87) PCT Pub. No.: WO2024/201610
PCT Pub. Date: Oct. 3, 2024

(65) Prior Publication Data

US 2026/0055766 A1 Feb. 26, 2026

(51) Int. Cl.
*F04C 18/02* (2006.01)

(52) U.S. Cl.
CPC ..... *F04C 18/0215* (2013.01); *F04C 2240/30* (2013.01); *F04C 2240/50* (2013.01); *F04C 2270/125* (2013.01)

(58) Field of Classification Search
CPC ..... F04C 18/0215; F04C 2240/30; F04C 2240/50; F04C 2270/125
See application file for complete search history.

(56) References Cited

U.S. PATENT DOCUMENTS 5,466,134 A 11/1995 Shaffer et al.
5,632,612 A * 5/1997 Shaffer ..... F04C 18/0284 418/142
2017/0234130 A1* 8/2017 Yamazaki ..... F01C 21/008 418/55.3

FOREIGN PATENT DOCUMENTS

JP 10-506161 A 6/1998
JP 2008-202522 A 9/2008
JP 2012196045 A * 10/2012
WO WO 2016/038694 A1 3/2016

OTHER PUBLICATIONS

English Translation JP-2012196045-A (Year: 2012).*
(Continued)

*Primary Examiner* — Shafiq Mian
(74) *Attorney, Agent, or Firm* — Crowell & Moring LLP

(57) ABSTRACT

A scroll-type fluid machine includes a casing that houses an orbiting scroll and a plurality of auxiliary crank mechanisms, a leg section that is disposed on a radially outer edge portion of the casing and supports the casing, and a reinforcing rib that extends on the leg section in the axial direction. The casing includes bearing bosses that each house a casing-side bearing of the auxiliary crank mechanism. The bearing boss has an outer circumferential surface and an end surface that form part of the outer surface of the casing. The reinforcing rib extends from the leg section to the bearing boss so as to be connected to the leg section and to the outer circumferential surface and the end surface of the bearing boss.

9 Claims, 9 Drawing Sheets

(56) References Cited

OTHER PUBLICATIONS

International Search Report (PCT/ISA/210) issued in PCT Application No. PCT/JP2023/011992 dated May 23, 2023 with English translation (5 pages).
Japanese-language Written Opinion (PCT/ISA/237) issued in PCT Application No. PCT/JP2023/011992 dated May 23, 2023 with English translation (7 pages).

* cited by examiner

[FIG. 1]
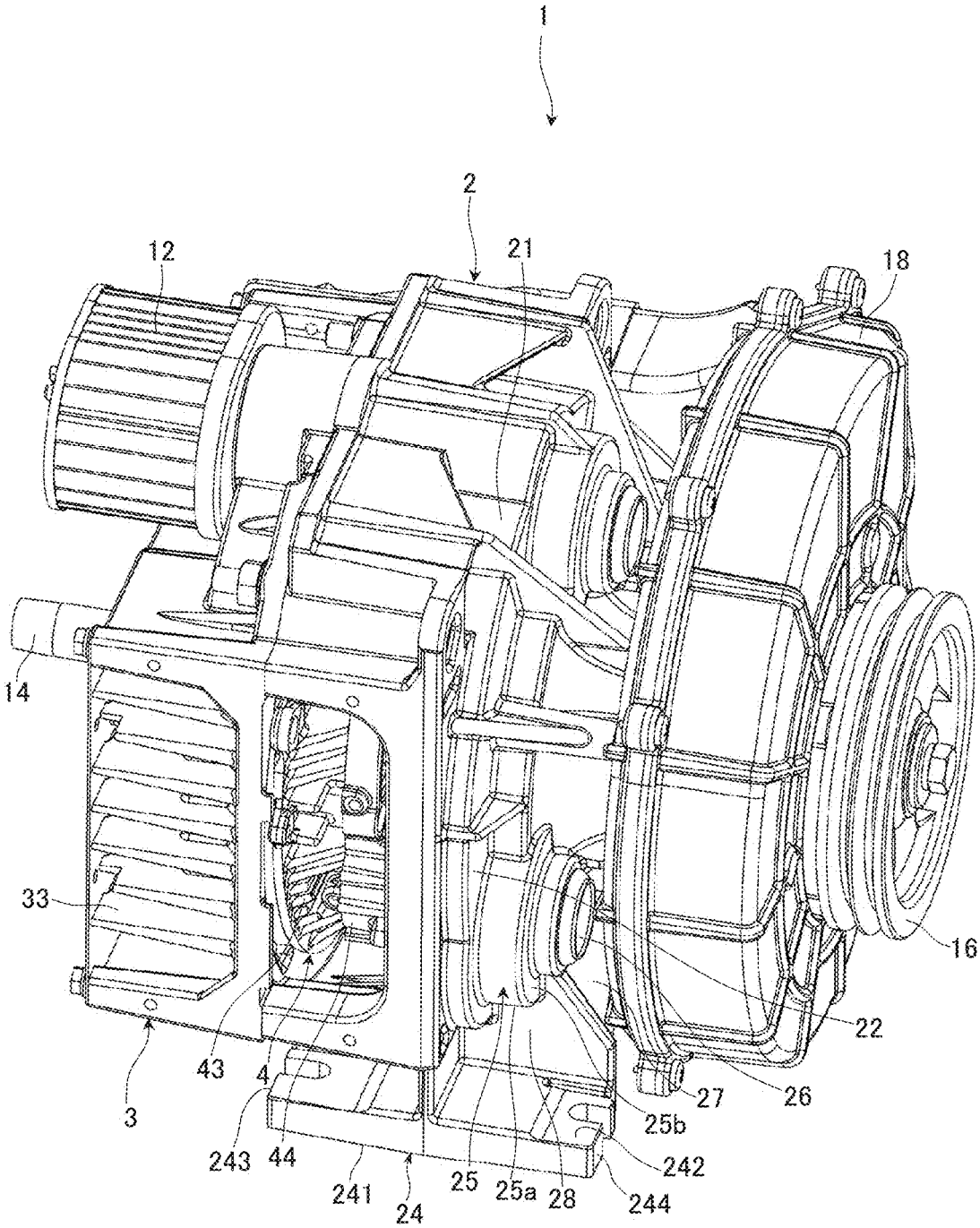

[FIG. 2]
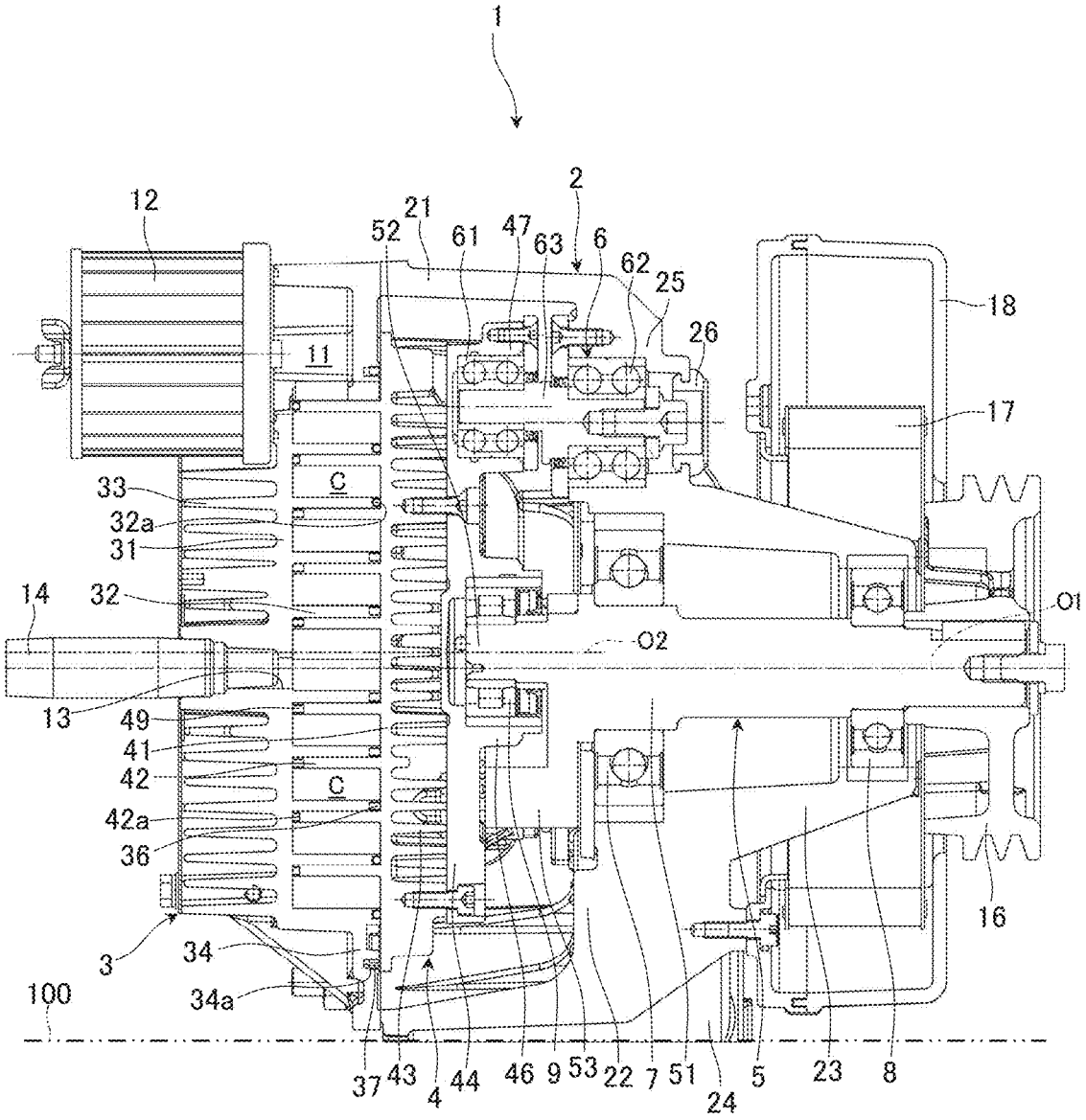

[FIG. 3]
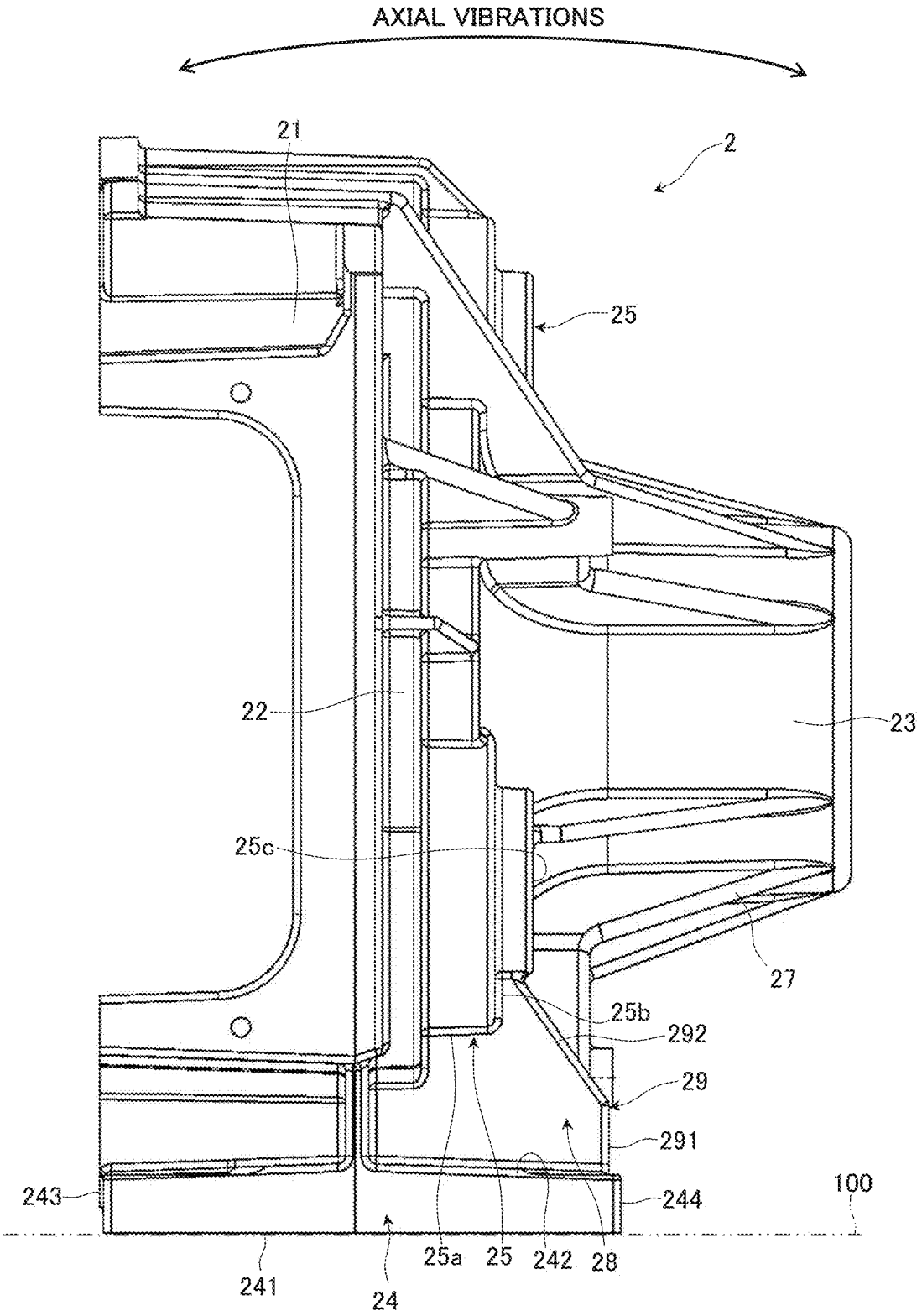

[FIG. 4]
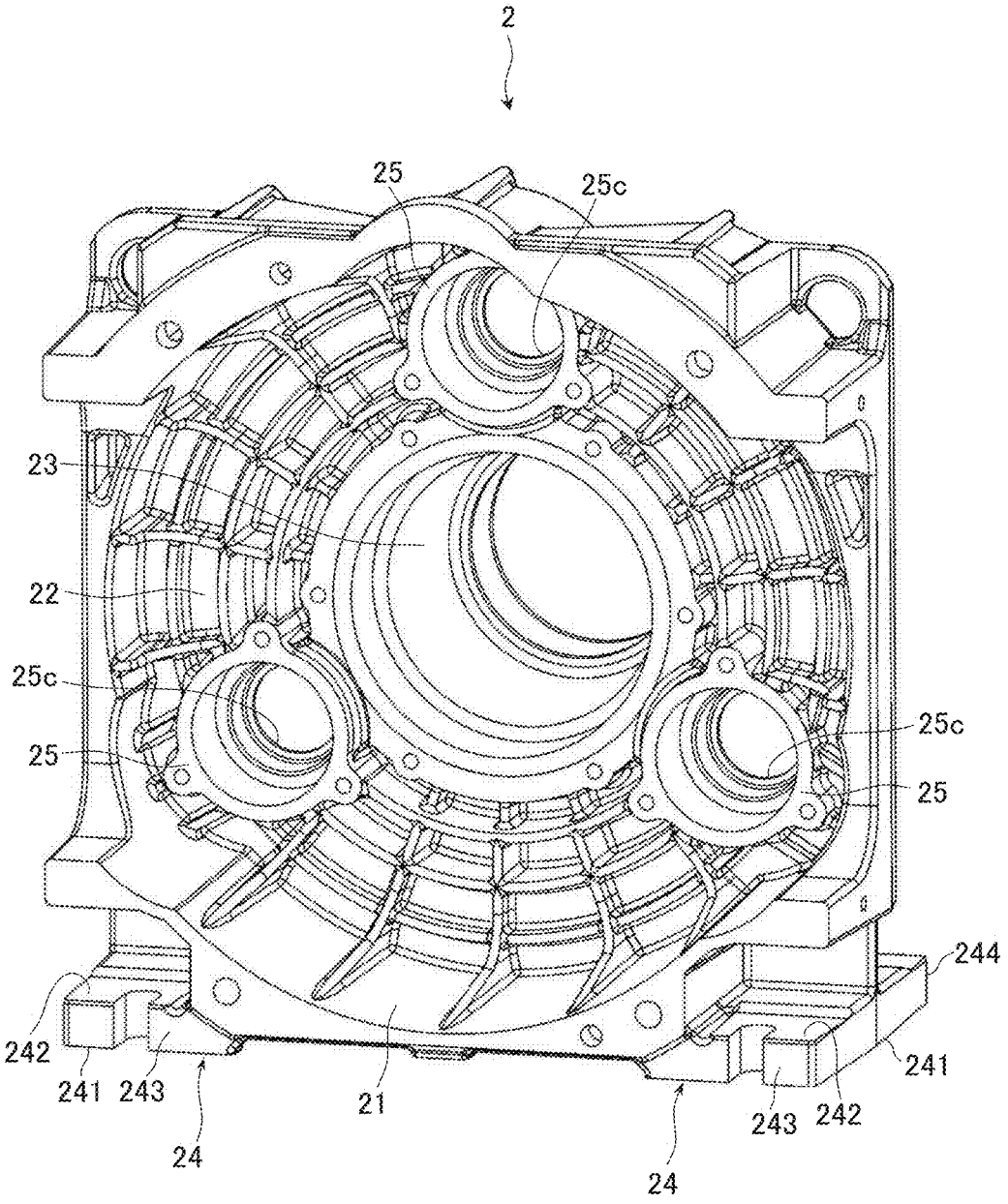

[FIG. 5]
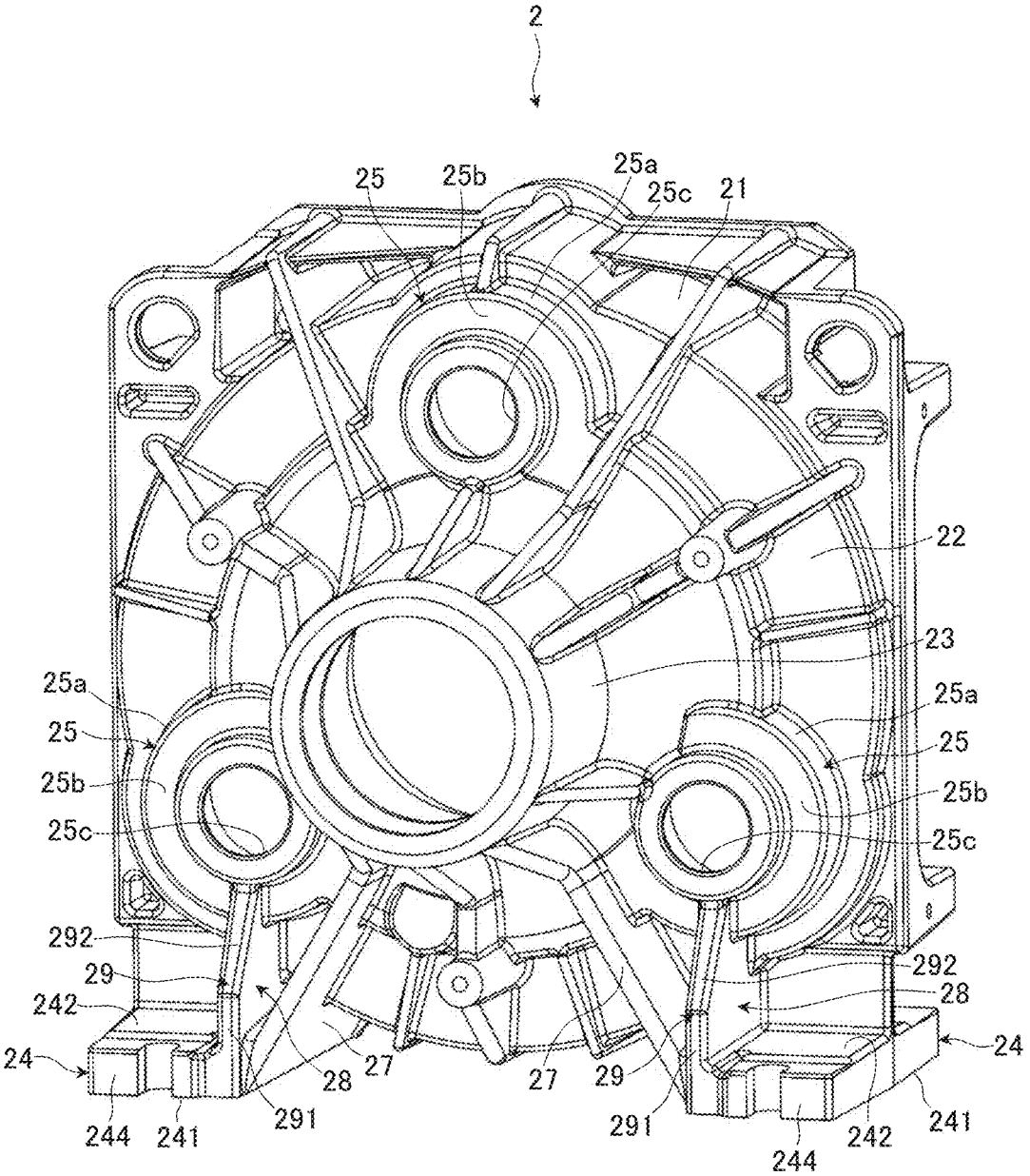

[FIG. 6]
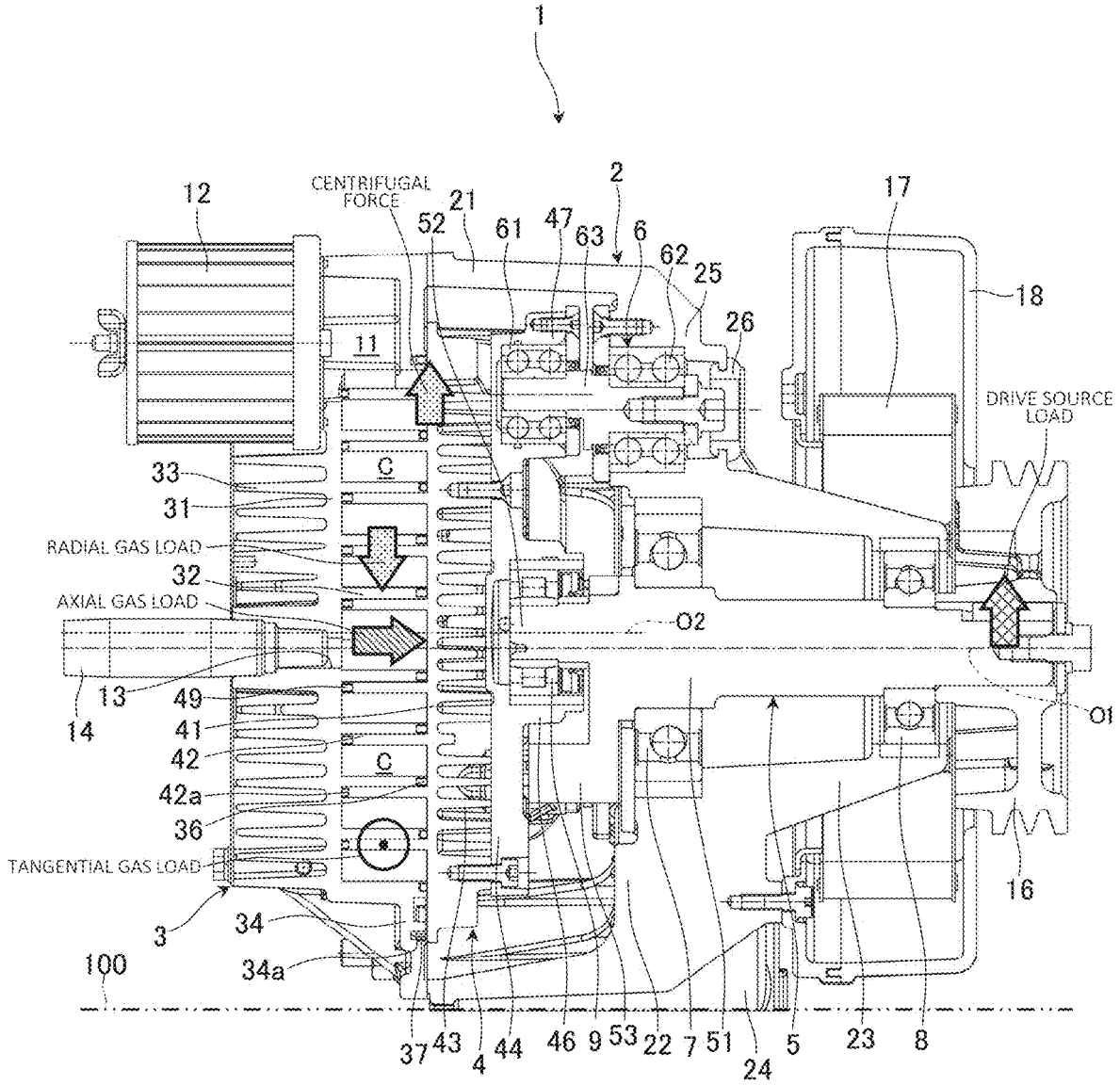

[FIG. 7]
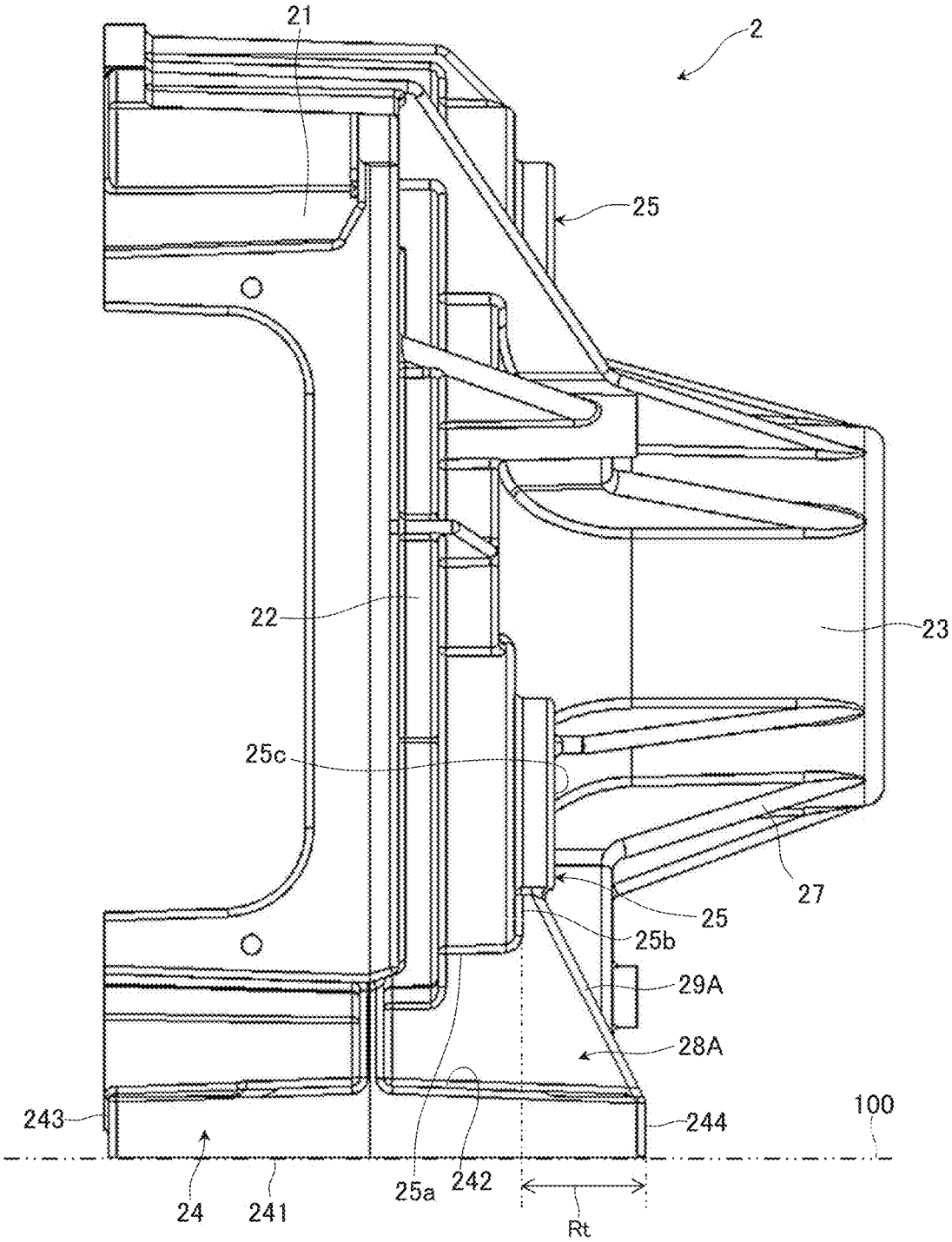

[FIG. 8]
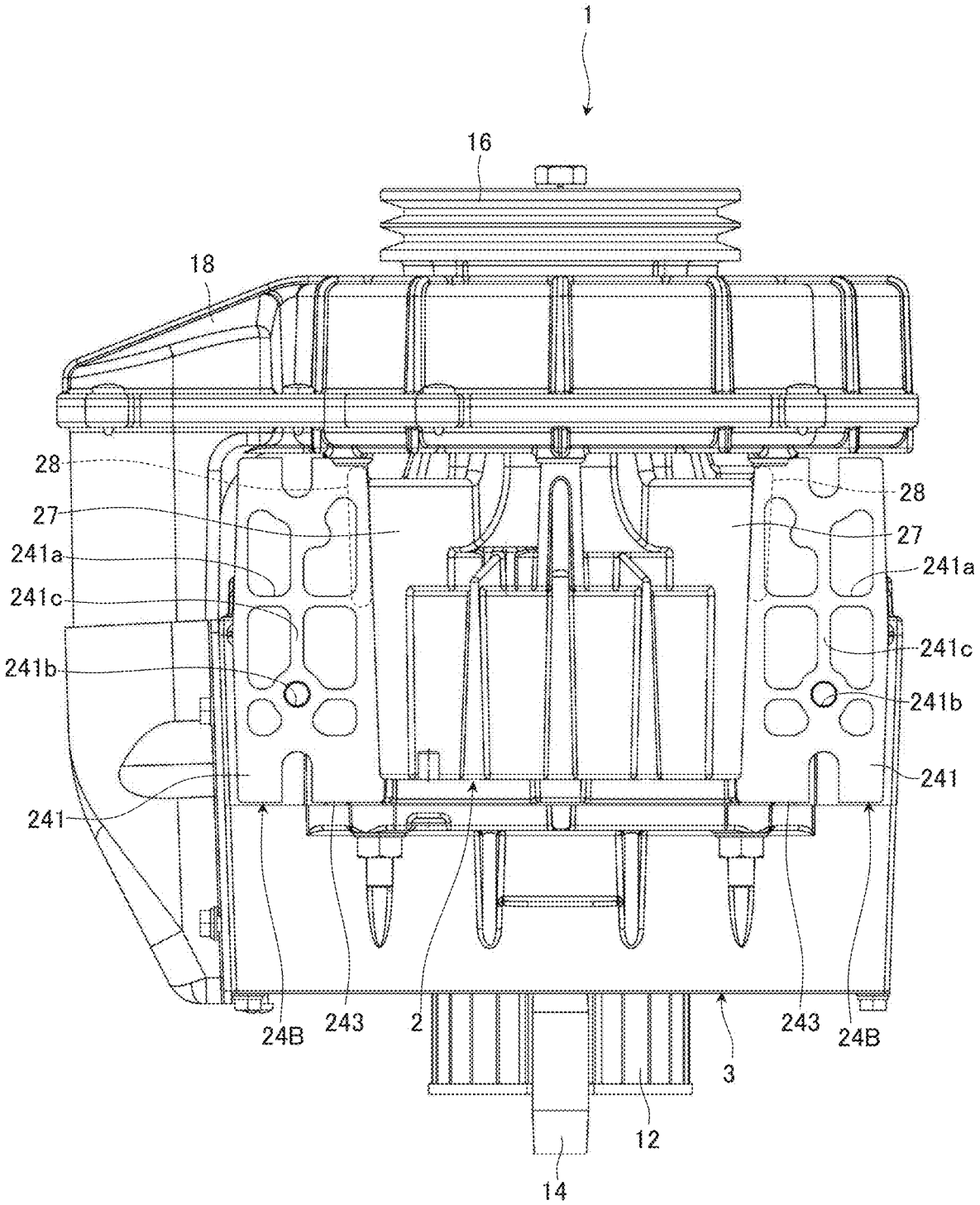

[FIG. 9]
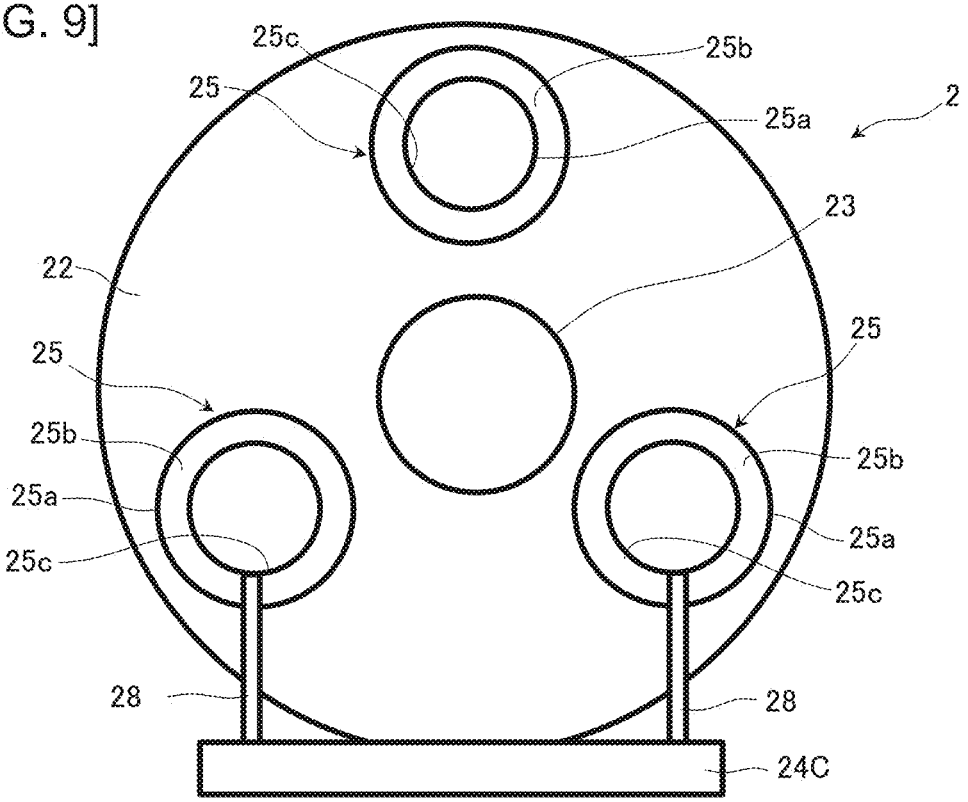
[FIG. 10]
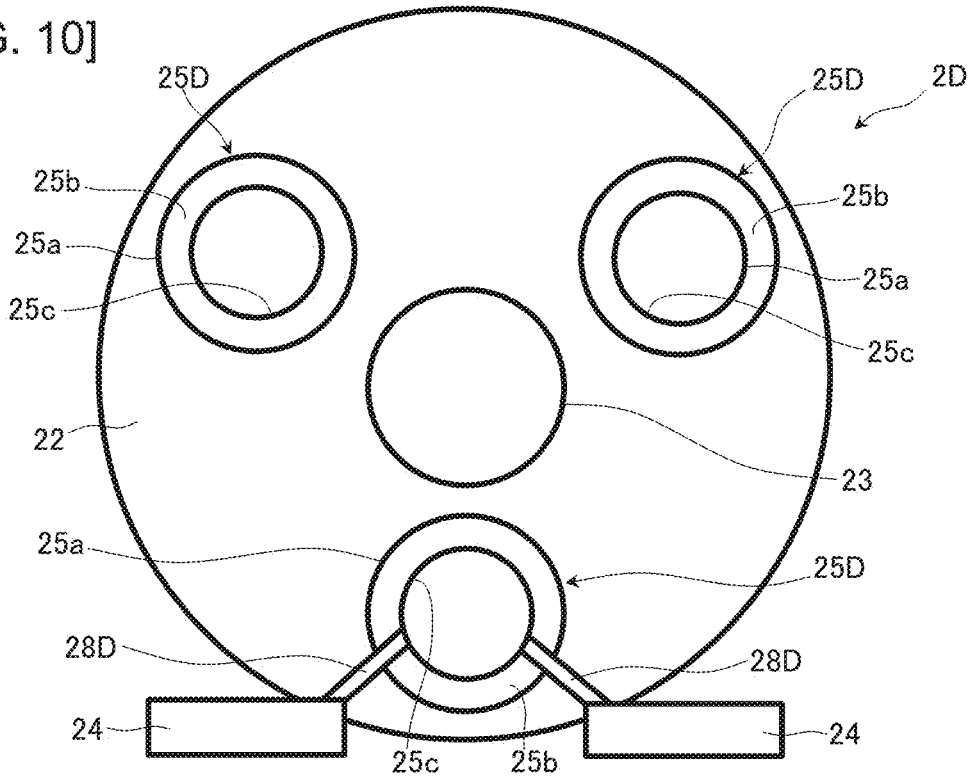

SCROLL-TYPE FLUID MACHINE

TECHNICAL FIELD

The present invention relates to scroll-type fluid machines such as a scroll-type compressor and a scroll-type vacuum pump.

BACKGROUND ART

In general, the scroll-type fluid machine includes a fixed scroll and an orbiting scroll that faces the fixed scroll. The fixed scroll and the orbiting scroll have an end plate with a circular plate shape and a spiral wrap erected on the end plate. The fixed scroll and the orbiting scroll form a plurality of compression chambers by overlapping the spiral wraps with each other.

In the scroll-type fluid machine, the orbiting scroll executes orbital motion with a constant orbiting radius with respect to the fixed scroll. This causes sequential execution of a suction process to suck a gas into the compression chamber, a compression process to compress the gas in the compression chamber, and a discharge process to discharge the compressed gas in the compression chamber to the external. As above, the scroll-type fluid machine is a machine that applies a force to a fluid by the orbiting of the orbiting scroll. Thus, vibrations occur due to the orbiting of the orbiting scroll and the movement of the fluid accompanying this orbiting.

A technology described in Patent Document 1 is known as a method of reducing such vibrations in the scroll-type fluid machine. A compressor described in Patent Document 1 includes a front case having an opening at an end portion on one side, a rear case fixed to the front case in the state in which the rear case closes the opening of the front case, and a fixed scroll that is housed in the front case and is fixed to the rear case. The technology described in Patent Document 1 has ribs extending substantially radially on the rear case, annular ribs along the outer circumferential edge of the rear case, ribs extending along the axial direction on the outer circumferential surface of the front case, or ribs extending substantially radially on the end surface of the front case on the other side, in order to reduce vibrations of the rear case and the front case to implement reduction in noise.

It is to be noted that the compressor described in Patent Document 1 is assumed to be used for an air conditioning device for a vehicle. According to a configuration, a structure, and assumed intended-use regarding this compressor, the compressor is considered to have a configuration in which an end portion of the front case on the other side (portion that is on the opposite side to the side fixed to the rear case and is on the side on which a drive shaft penetrates) is fixed to predetermined equipment of the air conditioning device for the vehicle. That is, for this compressor, it is considered that a leg section for fixing is disposed at the axial end portion of the front case.

Moreover, in this compressor, an Oldham ring is employed as a mechanism that inhibits the rotation of the orbiting scroll when the orbiting scroll executes orbital motion. The Oldham ring is, for example, an annular member having a plurality of keys. The keys of the Oldham ring engage with a key groove formed in the orbiting scroll and a key groove formed in the front case. In this mechanism, the Oldham ring slides along the key groove of the orbiting scroll and the key groove of the front case during the orbital motion of the orbiting scroll. This inhibits the rotation of the orbiting scroll.

PRIOR ART DOCUMENT

Patent Document

Patent Document 1: JP-2008-202522-A

SUMMARY OF THE INVENTION

Problem to be Solved by the Invention

Incidentally, in the scroll-type fluid machine for industrial use, a leg section for fixing is disposed at not an axial end portion of a casing (rear case and front case) but part of an outer circumferential edge portion (circumferential edge portion on a radially outer side) of the casing in some cases differently from the case of the scroll-type compressor described in Patent Document 1, which case is assumed to be used for the air conditioning device for the vehicle. Moreover, an auxiliary crank mechanism is employed as a rotation prevention mechanism for the orbiting scroll in some cases. The auxiliary crank mechanism is interposed between the orbiting scroll and the casing, and in addition, a plurality of auxiliary crank mechanisms are arranged at intervals in the circumferential direction of the orbiting scroll, for example. The auxiliary crank mechanisms have a function of receiving the thrust load (fluid force) that acts on the orbiting scroll, in addition to the function of preventing the rotation of the orbiting scroll.

Since the vibrations of the scroll-type fluid machine occur due to the orbital motion of the orbiting scroll, it has been considered that vibrations in the radial direction are main vibrations. However, from an analysis result, it has turned out that vibrations that occur in the axial direction, with a leg section being the fulcrum, are also main vibrations in the case in which the scroll-type fluid machine is fixed through the leg section disposed at an outer circumferential edge portion of the casing and the auxiliary crank mechanisms are employed as a rotation prevention mechanism for the orbiting scroll. That is, a new problem has been found that in order to suppress the vibrations of the scroll-type fluid machine with such a configuration, not only the radial vibrations but also the axial vibrations of the casing that occur with the leg section being the fulcrum need to be suppressed.

The present invention is made in order to resolve the above-described problem, and an object thereof is to provide a scroll-type fluid machine that can suppress vibrations of a casing that occur in the axial direction with a leg section for fixing being the fulcrum.

Means for Solving the Problem

The present application includes a plurality of means to solve the above-described problem. To cite an example thereof, a scroll-type fluid machine includes an orbiting scroll that executes orbital motion, a drive shaft that drives the orbiting scroll, a rotation prevention mechanism that prevents the rotation of the orbiting scroll, a casing that houses the orbiting scroll and the rotation prevention mechanism, a leg section that is disposed on a radially outer edge portion of the casing and supports the casing, and a reinforcing rib that extends on the leg section in the axial direction of the drive shaft. The rotation prevention mechanism includes a plurality of auxiliary crank mechanisms that are interposed between the orbiting scroll and the casing and are arranged at intervals in the circumferential direction of the orbiting scroll. The plurality of auxiliary crank mechanisms each have a first bearing disposed on the side of the orbiting scroll, a second bearing disposed on the side of the casing, and an auxiliary crank coupled on one side to the first bearing and on another side to the second bearing. The casing includes bearing bosses that each house the second bearing. The bearing bosses each have an outer circumferential surface that forms part of an outer surface of the casing and is located radially outside the second bearing, and an end surface that forms part of the outer surface of the casing, extends radially inward from a circumferential edge of the outer circumferential surface, and is oriented in the axial direction of the drive shaft. The reinforcing rib extends from the leg section to one of the bearing bosses so as to be connected to the leg section and to be connected to the outer circumferential surface and the end surface of the one of the bearing bosses.

Advantages of the Invention

According to the present invention, the reinforcing rib extending in the axial direction extends from the leg section to the bearing boss so as to be connected to the leg section and to the outer circumferential surface and the end surface of the bearing boss. This allows the rigidity of the leg section and the bearing boss to be enhanced in the axial direction. Thus, it can suppress the vibrations of the casing that occur in the axial direction with the leg section being the fulcrum.

Problems, configurations, and effects other than those described above are made apparent from description of the following embodiments.

BRIEF DESCRIPTION OF THE DRAWINGS

FIG. 1 is a perspective view depicting the appearance of a scroll compressor as a scroll-type fluid machine according to a first embodiment of the present invention.

FIG. 2 is a longitudinal cross-sectional view of the scroll compressor according to the first embodiment depicted in FIG. 1.

FIG. 3 is a side view depicting a casing that forms part of the scroll compressor according to the first embodiment depicted in FIG. 1.

FIG. 4 is a perspective view obtained when the casing of the scroll compressor according to the first embodiment depicted in FIG. 3 is viewed from one side in the axial direction.

FIG. 5 is a perspective view obtained when the casing of the scroll compressor according to the first embodiment depicted in FIG. 3 is viewed from the other side in the axial direction.

FIG. 6 is a diagram for explaining an excitation force (cause of vibrations) that acts on the scroll compressor according to the first embodiment.

FIG. 7 is a side view depicting the casing that forms part of a scroll-type fluid machine according to a second embodiment of the present invention.

FIG. 8 is a bottom view depicting a scroll-type fluid machine according to a third embodiment of the present invention.

FIG. 9 is a schematic diagram depicting an example of a leg section that supports the casing in a scroll-type fluid machine according to another embodiment of the present invention.

FIG. 10 is a schematic diagram depicting an example of the arrangement of bearing bosses of a casing in a scroll-type fluid machine according to another embodiment of the present invention.

MODES FOR CARRYING OUT THE INVENTION

Embodiments of the scroll-type fluid machine of the present invention are described below with use of the drawings. In the present embodiments, a description is given by taking a scroll compressor as an example of the scroll-type fluid machine. Moreover, in the present specification and the drawings, an element having substantially the same function or configuration is given the same numeral, and overlapping description is omitted.

First Embodiment

First, the configuration and structure of a scroll compressor as a scroll-type fluid machine according to a first embodiment are described with use of FIGS. 1 and 2. FIG. 1 is a perspective view depicting the appearance of the scroll compressor as the scroll-type fluid machine according to the first embodiment. FIG. 2 is a longitudinal cross-sectional view of the scroll compressor according to the first embodiment depicted in FIG. 1.

In FIGS. 1 and 2, a scroll compressor 1 as the scroll-type fluid machine is, for example, an air compressor of a scroll type and is fixed to an installation surface 100. The scroll compressor 1 includes a casing 2 in which one side in the axial direction (in FIG. 2, left side) is opened, a fixed scroll 3 fixed to the opening side of the casing 2, an orbiting scroll 4 housed in the casing 2 in such a state as to be opposite the fixed scroll 3, a drive shaft 5 that drives the orbiting scroll 4, and a rotation prevention mechanism 6 that prevents the rotation of the orbiting scroll 4. The drive shaft 5 is rotatably supported by the casing 2 through bearings 7 and 8, and is connected to the orbiting scroll 4 through an orbiting bearing 9. The rotation prevention mechanism 6 of the present embodiment is configured by a plurality of auxiliary crank mechanisms.

The casing 2 forms the outer shell of the scroll compressor 1 and has a housing space that houses the orbiting scroll 4 and a plurality of auxiliary crank mechanisms 6 (in FIG. 2, only one is depicted). Details of the configuration and structure of the casing 2 are described later.

The fixed scroll 3 is attached to an opening-side end portion (in FIG. 2, left-side end portion) of a housing cylindrical portion 21 to be described later in the casing 2. The fixed scroll 3 has an end plate 31 with a substantially circular shape, a spiral wrap 32 erected on a first surface that is a surface of the end plate 31 on the side facing the orbiting scroll 4 (in FIG. 2, right side), heat dissipating fins 33 erected on a second surface that is a surface of the end plate 31 on the opposite side to the first surface (in FIG. 2, left side), and an attachment support portion 34 that is provided at an outer circumferential edge portion of the end plate 31 in such a manner as to surround the wrap 32 from a radially outer side and is attached to a flange face of the opening-side end portion of the casing 2 (housing cylindrical portion 21 to be described later). The fixed scroll 3 is positioned such that the center thereof corresponds with a center line O1 to be described later in the drive shaft 5.

The orbiting scroll 4 is opposite the fixed scroll 3 in the axial direction and is positioned in the casing 2 (housing cylindrical portion 21 to be described later) so as to be capable of orbital motion. The orbiting scroll 4 has an end plate 41 with a substantially circular shape, a spiral wrap 42 erected on a first surface that is a surface of the end plate 41 on the side facing the fixed scroll 3 (in FIG. 2, left side), heat dissipating fins 43 erected on a second surface that is a surface of the end plate 41 on the opposite side to the first surface (in FIG. 2, right side), and a connection plate 44 attached to the tip side of the heat dissipating fins 43. The connection plate 44 is a part that connects the orbiting scroll 4 to the drive shaft 5, and has a cylindrical first bearing boss 46 in which the orbiting bearing 9 is housed (disposed). The connection plate 44 further has cylindrical second bearing bosses 47 in which scroll-side bearings 61 of the auxiliary crank mechanisms 6 to be described later are housed (disposed). The first bearing boss 46 is positioned such that the center thereof is radially eccentric with respect to the center line O1 of the drive shaft 5 to be described later by a predetermined dimension (orbiting radius). The plurality of second bearing bosses 47 are arranged at intervals in the circumferential direction of the connection plate 44 depending on the arrangement of the plurality of auxiliary crank mechanisms 6.

The fixed scroll 3 and the orbiting scroll 4 are arranged such that their wraps 32 and 42 overlap with each other when being viewed in the radial direction. Such arrangement causes spaces interposed between the end plate 31 of the fixed scroll 3 and the end plate 41 of the orbiting scroll 4 opposite each other and between the wrap 32 of the fixed scroll 3 and the wrap 42 of the orbiting scroll 4 overlapping with each other in the radial direction to be formed as a plurality of compression chambers C.

A tip of the wrap 32 of the fixed scroll 3A is provided with a groove 32*a*, and a tip seal 36 is placed in the groove 32*a* of the wrap 32. Similarly, a tip of the wrap 42 of the orbiting scroll 4 is provided with a groove 42*a*, and a tip seal 49 is placed in the groove 42*a* of the wrap 42. During the orbital motion of the orbiting scroll 4, the tip seal 36 of the fixed scroll 3 slides relative to the end plate 41 of the orbiting scroll 4, and the tip seal 49 of the orbiting scroll 4 slides relative to the end plate 31 of the fixed scroll 3. This suppresses mutual leakage of a compressed gas between the plurality of compression chambers C.

A portion facing the end plate 41 of the orbiting scroll 4 in the attachment support portion 34 of the fixed scroll 3 (portion on the radially outer side relative to the outermost circumference of the plurality of compression chambers C) is provided with a circular annular groove 34*a*. A circular annular face seal 37 is placed in the groove 34*a* of the attachment support portion 34. The face seal 37 slides relative to the end plate 41 of the orbiting scroll 4 to prevent the entry of dust and dirt into the compression chambers C.

In a region on the radially outer side relative to the end plate 31 in the fixed scroll 3, an intake flow path 11 is formed for taking a gas into the compression chambers C. One intake flow path 11 is positioned on the upper side of the fixed scroll 3 when the installation surface 100 of the scroll compressor 1 is set on the lower side, for example. A gas intake filter 12 is disposed at an inlet of the intake flow path 11. Moreover, a discharge port 13 for discharging the compressed gas is formed at a radially central portion of the end plate 31 in the fixed scroll 3. A discharge pipe 14 that introduces the compressed gas to a reservoir tank (not depicted) or the like is connected to the discharge port 13.

The drive shaft 5 transmits rotational power of a rotational drive source (not depicted) such as an electric motor to the orbiting scroll 4. The drive shaft 5 has a shaft main body 51 rotatably supported by the bearings 7 and 8 and a crank portion 52 monolithically provided at an end portion of the shaft main body 51 on one side (in FIG. 2, left end portion). The shaft main body 51 is configured to rotate around the center line O1, and the axial other side (in FIG. 2, right side) of the shaft main body 51 as the opposite side to the position of the crank portion 52 protrudes to the external of the casing 2 and is coupled to the rotational drive source (not depicted). The crank portion 52 is formed such that a center line O2 thereof is radially eccentric with respect to the center line O1 of the shaft main body 51 by the predetermined dimension (orbiting radius). The crank portion 52 is provided with a balance weight 53 for stabilizing the orbiting action of the orbiting scroll 4. The drive shaft 5 and the balance weight 53 integrally rotate.

The crank portion 52 of the drive shaft 5 is connected to the orbiting bearing 9 housed in the first bearing boss 46 in the connection plate 44 of the orbiting scroll 4. The rotation of the drive shaft 5 is converted to the orbital motion of the orbiting scroll 4 through the orbiting bearing 9 due to the eccentricity of the center O2 of the crank portion 52 with respect to the center line O1 of the shaft main body 51. The orbiting bearing 9 supports the orbiting scroll 4 such that the orbiting scroll 4 is capable of orbital motion, and compensates for the orbital motion of the orbiting scroll 4 with the predetermined orbiting radius with respect to the center line O1 of the drive shaft 5.

The plurality of auxiliary crank mechanisms 6 as the rotation prevention mechanism are interposed between the orbiting scroll 4 and the casing 2 and are arranged at intervals in the circumferential direction of the orbiting scroll 4. Specifically, the plurality of auxiliary crank mechanisms 6 are disposed in the casing 2 at positions closer to a bottom portion 22 of the casing 2 to be described later relative to the orbiting scroll 4 (on the back surface side as the opposite side to the side facing the fixed scroll 3). The rotation prevention mechanism is configured by, for example, three auxiliary crank mechanisms 6, and they are arranged at equal intervals of approximately 120° in the circumferential direction (see bearing bosses 25 to be described later for the auxiliary crank mechanisms 6 in FIGS. 4 and 5 to be described later). At least three auxiliary crank mechanisms 6 need to be disposed for exhibiting the rotation prevention function that doubles as supporting the thrust load.

The auxiliary crank mechanism 6 has the scroll-side bearing 61 disposed on the side of the orbiting scroll 4, a casing-side bearing 62 disposed on the side of the casing 2, and an auxiliary crank 63 coupled on one side to the scroll-side bearing 61 and on the other side to the casing-side bearing 62. The scroll-side bearing 61 is placed to be housed in the second bearing boss 47 in the connection plate 44 of the orbiting scroll 4. The casing-side bearing 62 is placed to be housed in the bearing boss 25 of the casing 2 to be described later. The plurality of auxiliary crank mechanisms 6 are configured such that one side of each auxiliary crank 63 is connected to the orbiting scroll 4 through the scroll-side bearing 61 and the other side of each auxiliary crank 63 is connected to the casing 2 through the casing-side bearing 62, thereby having a function of receiving the thrust load from the orbiting scroll 4 on the side of the casing 2 (bottom portion 22 to be described later) in addition to the function of inhibiting the rotation of the orbiting scroll 4.

A portion of the drive shaft 5 protruding to the outside of the casing 2 (end portion of the shaft main body 51 on the other side located on the opposite side to the crank portion 52) is provided with a pulley 16. A belt (not depicted) is stretched between the pulley 16 of the scroll compressor 1 and a pulley (not depicted) provided on the rotational drive source side. Due to this, the rotational driving force of the rotational drive source is transmitted to the drive shaft 5 through the pulley 16 to rotate the drive shaft 5. Thus, the orbiting scroll 4 executes orbital motion with respect to the fixed scroll 3. It is to be noted that it is also possible to employ a configuration in which the drive shaft 5 of the scroll compressor 1 is coupled to a rotating shaft of the rotational drive source by using a coupling or the like instead of the above-described pulley 16 and belt or a configuration in which both shafts are integrated.

A cooling fan 17 is attached to the end portion of the drive shaft 5 on the other side (in FIG. 2, right-side end portion) located on the opposite side to the crank portion 52. The cooling fan 17 is configured to rotate integrally with the drive shaft 5. Cooling air generated by the cooling fan 17 is supplied to the fixed scroll 3 and the orbiting scroll 4 through a fan duct 18. The fan duct 18 extends from the cooling fan 17 on the radially outer side relative to the fixed scroll 3 and the orbiting scroll 4. The fan duct 18 has a narrowed portion (not depicted) close to a position where the fixed scroll 3 and the orbiting scroll 4 are opposed, and is configured such that fluid resistance at the narrowed portion causes the flow of the cooling air to be divided into the side of the fixed scroll 3 and the side of the orbiting scroll 4.

Next, a description is given of the structure of the casing that forms part of the scroll-type fluid machine according to the first embodiment and a support structure for the casing with use of FIGS. 1 to 5. FIG. 3 is a side view depicting the casing that forms part of the scroll compressor according to the first embodiment depicted in FIG. 1. FIG. 4 is a perspective view obtained when the casing of the scroll compressor according to the first embodiment depicted in FIG. 3 is viewed from the one side in the axial direction. FIG. 5 is a perspective view obtained when the casing of the scroll compressor according to the first embodiment depicted in FIG. 3 is viewed from the other side in the axial direction.

The casing 2 of the scroll compressor 1 is formed, as depicted in FIGS. 2 to 5, as a bottomed cylindrical body in which the one side thereof in the axial direction (left side in FIG. 2, near side in the plane of paper of FIG. 4) is opened and the other side thereof in the axial direction (right side in FIG. 2, near side in the plane of paper of FIG. 5) is closed. Specifically, the casing 2 has the housing cylindrical portion 21 in which the one side thereof in the axial direction is opened, the annular bottom portion 22 that is integrally formed with an end portion of the housing cylindrical portion 21 on the other side in the axial direction and extends radially inward, and a cylindrical bearing attachment portion 23 extending in the axial direction (left-right direction in FIGS. 2 and 4) from an inner-circumferential-side portion of the bottom portion 22 toward the opposite side to the housing cylindrical portion 21. As depicted in FIGS. 1 and 3 to 5, the casing 2 is provided with leg sections 24 for fixing the casing 2 (scroll compressor 1) to the installation surface 100. The leg sections 24 support the casing 2 such that the axial direction (center line O1) of the drive shaft 5 is parallel to the installation surface 100 as depicted in FIG. 2.

Inside the housing cylindrical portion 21, the orbiting scroll 4 is positioned and the crank portion 52 and the balance weight 53 of the drive shaft 5 are positioned, as depicted in FIG. 2. In addition, the plurality of auxiliary crank mechanisms 6 are interposed between the connection plate 44 (back surface) of the orbiting scroll 4 in the housing cylindrical portion 21 and the bottom portion 22 of the casing 2.

The bottom portion 22 of the casing 2 is provided with the bearing bosses 25 each of which houses the casing-side bearing 62 of the auxiliary crank mechanism 6. The bearing bosses 25 are arranged at intervals in the circumferential direction at the bottom portion 22 of the casing 2 depending on the arrangement of the auxiliary crank mechanisms 6. When the rotation prevention mechanism is configured by three auxiliary crank mechanisms 6, three bearing bosses 25 are arranged at predetermined intervals in the circumferential direction as depicted in FIGS. 4 and 5. When the side of the installation surface 100 is set to the lower side, the bearing bosses 25 are arranged at a first position located directly above the bearing attachment portion 23 (drive shaft 5) and at second positions that exist on the lower side relative to the bearing attachment portion 23 (drive shaft 5) and are located on both left and right sides of the bearing attachment portion 23 (drive shaft 5) when being viewed in the axial direction of the drive shaft 5, for example.

Each of the bearing bosses 25 has such a shape as to bulge out from the bottom portion 22 in the axial direction of the drive shaft 5, as depicted in FIGS. 1, 3, and 5. The bearing boss 25 has an outer circumferential surface 25*a* and an end surface 25*b* that form part of the outer surface of the casing 2. The outer circumferential surface 25*a* of the bearing boss 25 is a surface that is located radially outside the casing-side bearing 62 of the auxiliary crank mechanism 6 and is oriented outward in the radial direction of the casing-side bearing 62. The end surface 25*b* of the bearing boss 25 is a surface that extends inward in the radial direction of the casing-side bearing 62 from the circumferential edge of the outer circumferential surface 25*a* and is oriented in the axial direction of the casing-side bearing 62 (drive shaft 5). The end surface 25*b* of the bearing boss 25 is provided with an opening 25*c* through which the casing-side bearing 62 can be accessed. The opening 25*c* of the bearing boss 25 is closed by a plug 26, as depicted in FIG. 2.

At the bearing attachment portion 23, as depicted in FIG. 2, the bearing 7 is disposed on the one side in the axial direction (in FIG. 2, left side) and the bearing 8 is disposed on the other side in the axial direction (in FIG. 2, right side). The bearing attachment portion 23 houses and supports the shaft main body 51 of the drive shaft 5 rotatably through the bearing 7 and the bearing 8.

The leg sections 24 are disposed on a radially outer edge portion of the housing cylindrical portion 21 (casing 2). For example, it is also possible to employ a configuration in which the leg sections 24 have a structure monolithic with the housing cylindrical portion 21 or a configuration in which the leg sections 24 are attached to the housing cylindrical portion 21 later by joining based on welding or the like. The leg sections 24 are thick plate-shaped members extending along the axial direction of the drive shaft 5, for example, and are each positioned on respective left and right sides at the outer circumferential edge portion of the housing cylindrical portion 21 when being viewed in the axial direction of the drive shaft 5, as depicted in FIGS. 4 and 5. The leg section 24 is arranged such that the bearing boss 25 is located substantially directly above the leg section 24. The leg section 24 has a bottom face 241 that gets contact with the installation surface 100, an upper face 242 oriented toward the opposite side to the bottom face 241, a first end face 243 that is oriented in the opposite direction to the end surface 25*b* of the bearing boss 25 and exists on the one side in the axial direction (in FIGS. 1 and 3, left side), and a second end face 244 that is oriented in the same direction as the end surface 25*b* of the bearing boss 25 and exists on the other side in the axial direction (in FIGS. 1 and 3, right side).

The first end face 243 and the second end face 244 are each provided with a notch to which fastening members (bolts or the like) for fixing the scroll compressor 1 (casing 2) to the installation surface 100 are attached.

The casing 2 provided with the leg sections 24 is provided with first reinforcing ribs 27 extending from the leg sections 24 to the bearing attachment portion 23 and second reinforcing ribs 28 extending from the leg sections 24 to the bearing bosses 25, as depicted in FIGS. 1, 3, and 5. The first reinforcing ribs 27 and the second reinforcing ribs 28 improve the rigidity of both the casing 2 and the leg sections 24. It is also possible to employ a configuration in which the first reinforcing ribs 27 and the second reinforcing ribs 28 have a structure monolithic with the casing 2 and the leg sections 24 or a configuration in which the first reinforcing ribs 27 and the second reinforcing ribs 28 are attached to the casing 2 and the leg sections 24 later by joining based on welding or the like.

The first reinforcing ribs 27 extend along the extension direction of the bearing attachment portion 23 (axial direction of the drive shaft 5), and extend from the leg sections 24 to the bearing attachment portion 23 so as to be connected to the inside side faces of the leg sections 24 and to the outer circumferential surface of the bearing attachment portion 23, for example, as depicted in FIG. 5. In other words, the first reinforcing ribs 27 extend outward in the radial direction of the bearing attachment portion 23 from the outer circumferential surface of the bearing attachment portion 23 and are connected to the leg sections 24. The first reinforcing ribs 27 are what intended to enhance the radial rigidity of the bearing attachment portion 23 of the casing 2.

The second reinforcing ribs 28 are what intended to suppress vibrations, described later, that occur in the axial direction of the casing 2 with the leg sections 24 being the fulcrum, and are configured to extend along the axial direction of the drive shaft 5 on the leg sections 24 as depicted in FIGS. 1, 3, and 5. Specifically, the second reinforcing rib 28 extends, on the upper face 242 of the leg section 24, from the position of the bottom portion 22 of the casing 2 to the position of the second end face 244 of the leg section 24 in the axial direction, for example, as depicted in FIGS. 1 and 3.

Moreover, the second reinforcing ribs 28 are each configured to extend from the respective leg sections 24 to the bearing bosses 25 closest to the leg sections 24. Specifically, the second reinforcing rib 28 extends from the leg section 24 to the bearing boss 25 so as to be connected to the upper face 242 of the leg section 24 and to be connected to the outer circumferential surface 25*a* and the end surface 25*b* of the bearing boss 25. The second reinforcing rib 28 is erected substantially orthogonally to the upper face 242 of the leg section 24 and extends to the bearing boss 25 located substantially directly above the leg section 24, for example, as depicted in FIG. 5. That is, the second reinforcing rib 28 extends with the shortest distance from the leg section 24 to the outer circumferential surface 25*a* of the bearing boss 25. The thickness of the second reinforcing rib 28 is constant, for example.

In addition, a tip edge 29 of the second reinforcing rib 28 in the axial direction has a bent shape formed by two sides, for example, as depicted in FIG. 3. Specifically, the tip edge 29 of the second reinforcing rib 28 in the axial direction is formed by a straight line-shaped first tip side 291 extending upward from the upper face 242 of the leg section 24 orthogonally to the axial direction of the drive shaft 5 and a straight line-shaped second tip side 292 inclined with respect to the first tip side 291 so as to be connected to an end of the first tip side 291 and the end surface 25*b* of the bearing boss 25.

Next, a description is given of operation of the scroll compressor according to the first embodiment and vibrations accompanying the operation with use of FIGS. 2, 3, and 6. FIG. 6 is a diagram for explaining an excitation force (cause of vibrations) that acts on the scroll compressor according to the first embodiment.

In the scroll compressor 1 depicted in FIG. 2, a driving force of the rotational drive source (not depicted) is transmitted to the drive shaft 5 through the pulley 16, and thereby the orbiting scroll 4 is driven. The orbiting scroll 4 executes orbital motion with respect to the fixed scroll 3 by the crank portion 52 of the drive shaft 5 in the state in which the rotation thereof is restricted by the plurality of auxiliary crank mechanisms 6.

Due to this, external air is sucked through the gas intake filter 12 and the intake flow path 11 of the fixed scroll 3 into a compression chamber C located on the radially outer side among a plurality of compression chambers C, and the air sucked into the compression chamber C is continuously compressed. The air compressed in the compression chamber C is finally discharged from the discharge port 13 of the fixed scroll 3 to the reservoir tank (not depicted) through the discharge pipe 14. Specifically, the plurality of compression chambers C move from the outer circumferential side in the extension direction of the spiral wrap 42 toward the inner circumferential side, according to the orbital motion of the orbiting scroll 4. This causes sequential execution of a suction process to suck a gas into the compression chamber C, a compression process to compress the gas in the compression chamber C, and a discharge process to discharge the compressed gas in the compression chamber C.

At this time, the orbiting scroll 4 is subjected to tangential, radial, and axial gas loads from the compressed air, as depicted in FIG. 6. In addition, the orbiting scroll 4 is subjected to a centrifugal force (radial force) due to the orbital motion of the orbiting scroll 4 itself. Moreover, the drive shaft 5 is subjected to a load attributed to the driving force of the rotational drive source through the pulley 16. The loads acting on the orbiting scroll 4 propagates to the bottom portion 22 of the casing 2 through the auxiliary crank mechanisms 6 (orbiting scroll-side bearings 61, auxiliary cranks 63, and casing-side bearings 62). The load acting on the drive shaft 5 propagates to the bearing attachment portion 23 of the casing 2 through the bearings 7 and 8.

In this manner, to the casing 2 of the scroll compressor 1, the loads acting on the orbiting scroll 4 propagates through the auxiliary crank mechanisms 6 and the load acting on the drive shaft 5 propagates through the bearings 7 and 8. This causes vibrations in the casing 2. Until now, it has been considered that the main factor of the vibrations of the casing 2 is the vibration mode oscillating radially due to the load by the driving force of the rotational drive source and the orbital motion of the orbiting scroll 4.

However, in the case in which the casing 2 is supported and is fixed to the installation surface 100 by the leg sections 24 disposed on the circumferential edge portion of the housing cylindrical portion 21 on the radially outer side and the plurality of auxiliary crank mechanisms 6 are employed as the rotation prevention mechanism for the orbiting scroll 4 as in the present embodiment, from an analysis result, it has been found that the vibration mode oscillating in the front-rear direction, with the leg sections 24 fixed to the installation surface 100 like that depicted in FIG. 3 being the fulcrum, is also a main part of the vibrations of the casing 2. That is, in the scroll compressor 1 having such a configuration, there is a need to reduce not only the vibration component in the radial direction that occurs in the casing 2 but also the vibration component in the axial direction.

To reduce the vibration component in the axial direction in the casing 2, there is a need to reduce the likelihood of excitation of the vibration mode in which the casing 2 oscillates in the front-rear direction, with the leg sections being the fulcrum, even when the above-described excitation force acts on the casing 2, and it is effective to enhance the rigidity of the casing 2. Thus, in the present embodiment, as depicted in FIGS. 1, 3, and 5, the second reinforcing ribs 28 are provided which enhance the rigidity of the leg sections 24 in the axial direction of the scroll compressor 1.

Specifically, in the present embodiment, the second reinforcing rib 28 axially extends on the leg section 24, and extends from the leg section 24 to the bearing boss 25 so as to be connected to the leg section 24 and to be connected to the outer circumferential surface 25*a* and the end surface 25*b* of the bearing boss 25. Improvement in the rigidity of the leg sections 24 suppresses its deformation in the axial direction. Moreover, Improvement in the rigidity of the end surface 25*b* of the bearing boss 25 suppresses its deformation in the axial direction. The bearing boss 25 is a part that houses the casing-side bearing 62 of the auxiliary crank mechanism 6 having the function of receiving the thrust load from the orbiting scroll 4, and thus can suppress excitation of the vibration mode in which the casing 2 oscillates in the front-rear direction, with the leg sections 24 being the fulcrum.

As described above, the scroll compressor 1 (scroll-type fluid machine) according to the first embodiment includes the orbiting scroll 4 that executes orbital motion, the drive shaft 5 that drives the orbiting scroll 4, the rotation prevention mechanism 6 that prevents the rotation of the orbiting scroll 4, the casing 2 that houses the orbiting scroll 4 and the rotation prevention mechanism 6, the leg section 24 that is disposed on the radially outer edge portion of the casing 2 and supports the casing 2, and the second reinforcing rib 28 (reinforcing rib) that extends on the leg section 24 in the axial direction of the drive shaft 5. The rotation prevention mechanism 6 includes the plurality of auxiliary crank mechanisms that are interposed between the orbiting scroll 4 and the casing 2 and are arranged at intervals in the circumferential direction of the orbiting scroll 4. The plurality of auxiliary crank mechanisms 6 each have the scroll-side bearing 61 (first bearing) disposed on the side of the orbiting scroll 4, the casing-side bearing 62 (second bearing) disposed on the side of the casing 2, and the auxiliary crank 63 coupled on one side to the scroll-side bearing 61 (first bearing) and on the other side to the casing-side bearing 62 (second bearing). The casing 2 includes the bearing bosses 25 that each house the casing-side bearing 62 (second bearing). The bearing bosses 25 each have the outer circumferential surface 25*a* that forms part of the outer surface of the casing 2 and is located radially outside the casing-side bearing 62 (second bearing), and the end surface 25*b* that forms part of the outer surface of the casing 2 and extends radially inward from the circumferential edge of the outer circumferential surface 25*a* and is oriented in the axial direction. The second reinforcing rib 28 (reinforcing ribs) extends from the leg section 24 to one of the bearing bosses 25 so as to be connected to the leg section 24 and to be connected to the outer circumferential surface 25*a* and the end surface 25*b* of the one of the bearing bosses 25.

According to this configuration, the second reinforcing rib 28 (reinforcing rib) extending in the axial direction extends from the leg section 24 to the bearing boss 25 so as to be connected to the leg section 24 and to the outer circumferential surface 25*a* and the end surface 25*b* of the bearing boss 25. This allows the rigidity of the leg section 24 and the bearing boss 25 to be enhanced in the axial direction. Therefore, it is possible to suppress the vibrations of the casing 2 that occur in the axial direction, with the leg section 24 being the fulcrum. In particular, since the auxiliary crank mechanism 6 including the casing-side bearing 62 (second bearing) housed in the bearing boss 25 has the function of receiving the thrust load that acts on the orbiting scroll 4, enhancing the rigidity of the end surface 25*b* of the bearing boss 25 to suppress deformation in the axial direction can suppress the axial vibrations of the casing 2.

Moreover, in the present embodiment, the second reinforcing rib 28 (reinforcing ribs) extends to the tip of the leg section 24 on the side of the bearing bosses 25 in the axial direction.

According to this configuration, the axial length of the second reinforcing rib 28 (reinforcing rib) on the leg section 24 becomes the longest, and this can further improve the rigidity of the leg section 24 in the axial direction. Therefore, the axial vibrations of the casing 2 that occur with the leg section 24 being the fulcrum can be suppressed at a higher degree.

Moreover, in the present embodiment, the tip edge 29 of the second reinforcing rib 28 (reinforcing rib) in the axial direction is formed by the straight line-shaped first tip side 291 extending upward from the leg section 24 orthogonally to the axial direction and the straight line-shaped second tip side 292 inclined with respect to the first tip side 291 so as to be connected to an end of the first tip side 291 and the end surface 25*b* of the one of the bearing bosses 25.

According to this configuration, it is possible to avoid increase in the volume of the second reinforcing rib 28 (reinforcing rib) while enhancing the rigidity of the leg section 24 in the axial direction by a portion on the side of the first tip side 291 in the second reinforcing rib 28 (reinforcing rib). This can suppress increase in the weight of the scroll compressor 1. In addition, the second tip side 292 inclined with respect to the first tip side 291 can suppress the deterioration of the maintenance performance, such as the deterioration of the accessibility to the bearing boss 25, due to the disposing of the second reinforcing rib 28 (reinforcing rib).

Moreover, in the present embodiment, the casing 2 has the housing cylindrical portion 21 (housing portion) inside which the orbiting scroll 4 is positioned, and the annular bottom portion 22 that is provided at the end portion of the housing cylindrical portion 21 (housing portion) on one side in the axial direction and has the bearing bosses 25 arranged circumferentially. The leg sections 24 are each positioned on respective left and right sides at the radially outer edge portion of the housing cylindrical portion 21 (housing portion) when being viewed in the axial direction. When the leg sections 24 are set on the lower side, one of the bearing bosses is arranged at a position directly above each of the leg sections 24, and the second reinforcing ribs 28 (reinforcing ribs) extend with the shortest distance from the leg sections 24 to the outer circumferential surfaces 25*a* of the bearing bosses 25.

According to this configuration, the volume of the second reinforcing rib 28 (reinforcing rib) becomes smaller. This can suppress increase in the weight due to the second reinforcing rib 28 (reinforcing rib), and can suppress the deterioration of the maintenance performance due to the disposing of the second reinforcing rib 28 (reinforcing rib).

Second Embodiment

Next, a scroll-type fluid machine according to a second embodiment of the present invention is described with use of FIG. 7. FIG. 7 is a side view depicting the casing that forms part of the scroll-type fluid machine according to the second embodiment.

A difference of the scroll-type fluid machine according to the second embodiment from the scroll compressor according to the first embodiment (see FIG. 3) is that the shape of second reinforcing ribs 28A is different. The other structure in the scroll-type fluid machine according to the second embodiment is similar to the structure in the case of the first embodiment, and description thereof is omitted.

Specifically, the second reinforcing ribs 28A depicted in FIG. 7 each extend, on the upper face 242 of the leg section 24, from the position of the bottom portion 22 of the casing 2 to the position of the second end face 244 of the leg section 24 in the axial direction similarly to the second reinforcing ribs 28 of the first embodiment. In addition, the second reinforcing rib 28A extends from the leg section 24 to the bearing boss 25 in such a manner as to be connected to the upper face 242 of the leg section 24 and to be connected to the outer circumferential surface 25*a* and the end surface 25*b* of the bearing boss 25 closest to the leg section 24 similarly to the second reinforcing rib 28 of the first embodiment (see FIG. 3).

Tip edge 29A of the second reinforcing rib 28A in the axial direction has a straight line shape formed by one side differently from the second reinforcing rib 28 of the first embodiment. Specifically, the tip edge 29A is a side that extends from the position of the second end face 244 on the upper face 242 of the leg section 24 to the end surface 25*b* of the bearing boss 25 and is inclined with respect to a plane orthogonal to the axial direction.

It is to be noted that, for the second reinforcing ribs 28A, the position of the tip in the axial direction on the leg section 24 can be set to any position in a range Rt depicted in FIG. 7, specifically, a range from a position on the side of the second end face 244 relative to the position of the end surface 25*b* of the bearing boss 25 to the position of the second end face 244. That is, the second reinforcing rib 28A can be configured such that the position of the tip in the axial direction on the leg section 24 exists at an intermediate position between the position of the second end face 244 of the leg section 24 and the position of the end surface 25*b* of the bearing boss 25 in the axial direction. This is a condition that allows the second reinforcing ribs 28A to extend from the leg section 24 to the bearing boss 25 so as to be connected to the leg section 24 and to be connected to the end surface 25*b* of the bearing boss 25.

According to the above-described second embodiment, similarly to the case of the first embodiment, the second reinforcing rib 28A (reinforcing rib) extending in the axial direction extends from the leg section 24 to the bearing boss 25 so as to be connected to the leg section 24 and to the outer circumferential surface 25*a* and the end surface 25*b* of the bearing boss 25. This allows the rigidity of the leg section 24 and the bearing boss 25 to be enhanced in the axial direction. Therefore, it is possible to suppress the vibrations of the casing 2 that occur in the axial direction with the leg section 24 being the fulcrum.

Moreover, in the present embodiment, the second reinforcing rib 28A has the tip in the axial direction on the leg section 24 at an intermediate position between the tip of the leg section 24 in the axial direction and the position of the end surface 25*b* of the bearing boss 25 in the axial direction.

According to this configuration, the volume of the second reinforcing rib 28A becomes smaller as compared with the second reinforcing rib 28 of the first embodiment, which extends to the tip of the leg section 24 in the axial direction. Therefore, the weight of the second reinforcing rib 28A is reduced to a weight lower than that of the second reinforcing rib 28 of the first embodiment. In addition, the second reinforcing rib 28A has an axial length shorter than that of the second reinforcing rib 28 of the first embodiment. Thus, correspondingly, it becomes possible to avoid interference with other parts and achieve improvement in the workability at the time of assembly.

Moreover, in the present embodiment, the tip edge 29A of the second reinforcing rib 28A in the axial direction has a straight line shape formed by one side.

According to this configuration, the volume of the second reinforcing rib 28A becomes smaller as compared with the second reinforcing rib 28 of the first embodiment, in which the tip edge 29 in the axial direction has a bent shape formed by two sides. Therefore, the weight of the second reinforcing rib 28A is reduced to a weight lower than that of the second reinforcing rib 28 of the first embodiment. In addition, the occupation area of the second reinforcing rib 28A becomes smaller than that of the second reinforcing rib 28 of the first embodiment. Thus, correspondingly, it becomes possible to avoid interference with other parts and achieve improvement in the workability at the time of assembly.

Third Embodiment

Next, a scroll-type fluid machine according to a third embodiment of the present invention is described with use of FIG. 8. FIG. 8 is a bottom view depicting the scroll-type fluid machine according to the third embodiment.

A difference of the scroll-type fluid machine according to the third embodiment from the scroll compressor 1 according to the first embodiment is that the structure of leg sections 24B that support the casing 2 is different. The other structure in the scroll-type fluid machine according to the third embodiment is similar to the structure of the first embodiment, and description thereof is omitted.

Specifically, the leg sections 24B that support the casing 2 have a plurality of thinned portions 241*a* and one positioning hole 241*b* in the bottom face 241 thereof. The thinned portions 241*a* are recessed portions formed, from the bottom face 241 of the leg section 24B, into such a depth as not to penetrate upper face 242, and are formed in such a manner as to avoid the positioning hole 241*b*. The plurality of thinned portions 241*a* are arranged such that a lattice-shaped rib 241*c* is formed. The weight of the leg section 24B is reduced due to the thinned portion 241*a*. Moreover, in the leg sections 24B, the rib 241*c* formed among the plurality of thinned portions 241*a* suppresses the lowering of the strength due to the thinned portions 241*a*. Finishing processing for a flat surface is executed on the bottom face 241 of the leg section 24B in order to reduce rattling against the installation surface 100. In the present embodiment, the processing area of the finishing processing for the bottom face 241 becomes smaller due to the forming of the plurality of thinned portions 241*a* in the bottom face 241 of the leg section 24B. Therefore, the processing man-hour of the finishing processing can be reduced.

In the above-described third embodiment, it is possible to suppress the vibrations of the casing 2 that occur in the axial direction with the leg sections 24B being the fulcrum, similarly to the case of the first embodiment.

In addition, in the present embodiment, the leg section 24B has the thinned portions 241*a* in the bottom face 241 that becomes the contact side in installation. According to this configuration, the thinned portions 241*a* of the leg section 24B allow reduction in the weight of the leg section 24B to be achieved.

Moreover, in the present embodiment, the leg section 24B has the plurality of thinned portions 241*a*, and the thinned portions 241*a* are disposed such that the lattice-shaped rib 241*c* is defined in the bottom face 241 of the leg section 24B. This configuration can achieve a reduction in the weight of the leg section 24B and suppress the lowering of the strength accompanying the reduction in the weight.

OTHER EMBODIMENTS

It is to be noted that the present invention is not limited to the above-described embodiments and various modifications are included therein. The above-described embodiments are described in detail in order to explain the present invention in an easy-to-understand manner and are not necessarily limited to that including all configurations described. It is possible to replace part of a configuration of a certain embodiment by a configuration of another embodiment. Moreover, it is also possible to add a configuration of a certain embodiment to a configuration of another embodiment. In addition, it is also possible to execute addition, deletion, or substitution of another configuration regarding part of configurations of the respective embodiments.

For example, in the above-described embodiments, the examples have been depicted in which the leg sections 24 or 24B that support the casing 2 are each arranged on respective left and right sides at the radially outer edge portion of the casing 2 when being viewed in the axial direction. However, as depicted in FIG. 9, it is also possible that a leg section 24C is configured as one pedestal disposed on the lower side of the casing 2. FIG. 9 is a schematic diagram depicting an example of a leg section that supports the casing in a scroll-type fluid machine according to another embodiment of the present invention.

Also with the leg section 24C having this structure, the second reinforcing rib 28 is configured to extend from the leg section 24C to the bearing boss 25 in such a manner as to be connected to the outer circumferential surface 25*a* and the end surface 25*b* of the bearing boss 25 closest to the leg section 24C among the plurality of bearing bosses 25 of the casing 2. Also with this leg section 24C, it is possible to suppress the axial vibrations of the casing 2 that occur with the leg section 24B being the fulcrum.

Moreover, in the above-described embodiments, the examples have been depicted in which, when the installation surface 100 is set on the lower side, the three bearing bosses 25 of the casing 2 are arranged at the first position located directly above the bearing attachment portion 23 and at the second positions that exist on the lower side relative to the bearing attachment portion 23 and are located on both left and right sides of the bearing attachment portion 23 when being viewed in the axial direction. However, a configuration in which three bearing bosses 25D of a casing 2D are arranged as depicted in FIG. 10 is also possible. FIG. 10 is a schematic diagram depicting an example of the arrangement of bearing bosses of a casing in a scroll-type fluid machine according to another embodiment of the present invention.

Specifically, provided at the bottom portion 22 of the casing 2D are two bearing bosses 25D that are located on the upper side relative to the bearing attachment portion 23 and are located on both left and right sides of the bearing attachment portion 23 when being viewed in the axial direction and one bearing boss 25D that is located on the lower side relative to the bearing attachment portion 23 and is the closest to two leg sections 24. When the casing 2D has such a structure, the configuration is made such that each of the second reinforcing ribs 28D is connected to the leg section 24 and to the one bearing boss 25D closest to the leg section 24 among the plurality of bearing bosses 25D. Specifically, the second reinforcing ribs 28D are each configured to extend from the leg section 24 to the one bearing boss 25D located on the lower side relative to the bearing attachment portion 23 so as to be connected to the upper face 242 of the leg section 24 and to be connected to the outer circumferential surface 25*a* and the end surface 25*b* of this bearing boss 25D.

Also in the case of this configuration, the second reinforcing rib 28D (reinforcing rib) extending in the axial direction extends from the leg section 24 to the bearing boss 25D so as to be connected to the leg section 24 and to the outer circumferential surface 25*a* and the end surface 25*b* of the bearing boss 25D. This can enhance the rigidity of the leg section 24 and the bearing boss 25D in the axial direction. Therefore, it is possible to suppress the axial vibrations of the casing 2D that occur with the leg sections 24 being the fulcrum.

DESCRIPTION OF REFERENCE CHARACTERS

1: Scroll compressor (scroll-type fluid machine)
2, 2D: Casing
4: Orbiting scroll
5: Drive shaft
6: Auxiliary crank mechanism (rotation prevention mechanism)
21: Housing cylindrical portion (housing portion)
22: Bottom portion
24, 24B, 24C: Leg section
241: Bottom face
241*a*: Thinned portion
241*c*: Rib
25, 25D: Bearing boss
25*a*: Outer circumferential surface
25*b*: End surface
28, 28A, 28D: Second reinforcing rib (reinforcing rib)
29, 29A: Tip edge
291: First tip side
292: Second tip side
61: Scroll-side bearing (first bearing)
62: Casing-side bearing (second bearing)
63: Auxiliary crank

The invention claimed is:

1. A scroll-type fluid machine comprising:
an orbiting scroll that executes orbital motion;
a drive shaft that drives the orbiting scroll;
a rotation prevention mechanism that prevents rotation of the orbiting scroll;
a casing that houses the orbiting scroll and the rotation prevention mechanism;
a leg section that is disposed on a radially outer edge portion of the casing and supports the casing; and
a reinforcing rib that extends on the leg section in an axial direction of the drive shaft, wherein
the rotation prevention mechanism includes a plurality of auxiliary crank mechanisms that are interposed between the orbiting scroll and the casing and are arranged at intervals in a circumferential direction of the orbiting scroll, the plurality of auxiliary crank mechanisms each have a first bearing disposed on a side of the orbiting scroll, a second bearing disposed on a side of the casing, and an auxiliary crank coupled on one side to the first bearing and on another side to the second bearing, the casing includes bearing bosses that each house the second bearing, the bearing bosses each have a bearing housing portion, and a opening that extends from the bearing housing portion to an axially opposite load side, the bearing housing portion has an outer circumferential surface that forms part of an outer surface of the casing and is located radially outside the second bearing, and an axial end surface that forms part of the outer surface of the casing, extends radially inward from a circumferential edge of the outer circumferential surface, and is oriented in the axial direction, and the reinforcing rib extends from the leg section to one of the bearing bosses so as to be connected to the leg section and to be connected to the outer circumferential surface and the axial end surface of the bearing housing portion.

2. The scroll-type fluid machine according to claim 1, wherein the reinforcing rib extends to a position of a tip of the leg section in the axial direction.

3. The scroll-type fluid machine according to claim 1, wherein a tip edge of the reinforcing rib in the axial direction is formed by a straight line-shaped first tip side and a straight line-shaped second tip side, the first tip side extending upward from the leg section orthogonally to the axial direction, the second tip side being inclined with respect to the first tip side so as to be connected to an end of the first tip side and the axial end surface of the bearing housing portion.

4. The scroll-type fluid machine according to claim 1, wherein the casing has a housing portion inside which the orbiting scroll is positioned, and an annular bottom portion that is provided at an end portion of the housing portion on one side in the axial direction, and has the bearing bosses arranged circumferentially, the leg section is positioned on each of both left and right sides at a radially outer edge portion of the housing portion when being viewed in the axial direction, when the leg sections are set on a lower side, one of the bearing bosses is arranged at a position directly above each of the leg sections, and the reinforcing rib extends from one of the leg sections to the outer circumferential surface of the bearing housing portion such that an extension distance is a shortest distance.

5. The scroll-type fluid machine according to claim 1, wherein the reinforcing rib has a tip in the axial direction on the leg section at an intermediate position between a tip of the leg section in the axial direction and a position of the axial end surface of the bearing housing portion in the axial direction.

6. The scroll-type fluid machine according to claim 1, wherein a tip edge of the reinforcing rib in the axial direction has a straight line shape formed by one side.

7. The scroll-type fluid machine according to claim 1, wherein the leg section has a thinned portion with a recessed shape in a bottom face that becomes a contact side in installation.

8. The scroll-type fluid machine according to claim 7, wherein the leg section has a plurality of the thinned portions, and the thinned portions are disposed such that a lattice-shaped rib is defined in the bottom face.

9. The scroll-type fluid machine according to claim 1, wherein the reinforcing rib extends from the leg section to a bearing boss closest to the leg section among the bearing bosses.

* * * * *